US011719006B2

(12) United States Patent
McCracken

(10) Patent No.: US 11,719,006 B2
(45) Date of Patent: Aug. 8, 2023

(54) CLAMP FOR INTERCONNECTING COMPONENTS OF A SHORING APPARATUS

(71) Applicant: Wilian Holding Co., Des Moines, IA (US)

(72) Inventor: Robert McCracken, Urbandale, IA (US)

(73) Assignee: Wilian Holding Co., Des Moines, IA (US)

( * ) Notice: Subject to any disclaimer, the term of this patent is extended or adjusted under 35 U.S.C. 154(b) by 210 days.

(21) Appl. No.: 17/119,208

(22) Filed: Dec. 11, 2020

(65) Prior Publication Data

US 2021/0180344 A1 Jun. 17, 2021

Related U.S. Application Data

(60) Provisional application No. 62/948,587, filed on Dec. 16, 2019.

(51) Int. Cl.
*E04G 7/32* (2006.01)
*E04G 7/26* (2006.01)
(Continued)

(52) U.S. Cl.
CPC ..... *E04G 7/32* (2013.01); *E04G 7/26* (2013.01); *E04G 7/303* (2013.01); *E04G 9/08* (2013.01); *E04G 17/00* (2013.01)

(58) Field of Classification Search
CPC ..... E04G 7/303; E04G 7/22; E04G 7/302; E04G 7/32; E04G 7/26; E04G 17/00; E04G 9/08; F16B 7/0473
See application file for complete search history.

(56) References Cited

U.S. PATENT DOCUMENTS 4,572,694 A * 2/1986 Hoeksema ..... F16B 7/0473 403/255
5,657,604 A * 8/1997 Malott ..... F16B 7/0473 403/255
(Continued)

FOREIGN PATENT DOCUMENTS

DE 3308964 A1 * 9/1984 ..... F16B 7/0473
DE 3607849 C1 * 8/1987 ..... F16B 7/0473
(Continued)

OTHER PUBLICATIONS

Translation of JP H08312164. (Year: 1996).*

*Primary Examiner* — Michael Safavi
(74) *Attorney, Agent, or Firm* — Dentons Davis Brown; Matthew Warner-Blankenship; Kassandra Ricklefs

(57) ABSTRACT

Disclosed herein is a clamp for interconnecting two components of a support apparatus such as components of a shoring apparatus for concrete forming systems. A clamp member having a moveable jaw is received for pivotal movement in a housing that is secured to one of the components. A plurality of flutes disposed at an angle to the pivot axis of the clamp member are received in coacting recesses in the housing and a proximal cap maintains the desired position of the clamp member within the housing. Axial movement of the clamp member will pivot the swing arm and a coacting, moveable jaw toward a fixed jaw formed in the housing to releasably secure the clamp to the other component.

17 Claims, 5 Drawing Sheets

(51) Int. Cl.

| | |
|---|---|
| ***E04G 7/30*** | (2006.01) |
| ***E04G 9/08*** | (2006.01) |
| ***E04G 17/00*** | (2006.01) |

(56) References Cited

U.S. PATENT DOCUMENTS

| | | | | |
|---|---|---|---|---|
| 5,713,687 | A * | 2/1998 | Schworer | E04G 7/304 403/374.1 |
| 6,322,277 | B1 * | 11/2001 | Jennings | E04G 7/308 403/174 |
| 8,408,835 | B1 * | 4/2013 | Zhang | F16B 7/0473 403/255 |
| 2001/0004432 | A1 * | 6/2001 | Pfister | F16M 13/022 403/188 |
| 2002/0023391 | A1 * | 2/2002 | Nymark | E04B 2/7453 211/94.01 |

FOREIGN PATENT DOCUMENTS

| | | | | |
|---|---|---|---|---|
| DE | 3703907 | A1 * | 8/1988 | F16B 7/0473 |
| DE | 29502330 | U1 * | 5/1995 | F16B 7/0473 |
| DE | 19517011 | A1 * | 11/1996 | F16B 12/32 |
| DE | 29913112 | U1 * | 10/1999 | F16B 7/0473 |
| DE | 19845138 | C1 * | 1/2000 | F16B 7/0413 |
| DE | 202011106399 | U1 * | 3/2012 | F16B 7/0473 |
| DE | 102021103968 | B3 * | 2/2022 | F16B 7/0473 |
| EP | 0337845 | A1 * | 10/1989 | F16B 7/0473 |
| ES | 2354336 | A1 * | 3/2011 | E04G 7/304 |
| FR | 2454551 | A1 * | 11/1980 | F16B 7/0473 |
| FR | 2655393 | A1 * | 6/1991 | E04G 7/26 |
| FR | 2717229 | A1 * | 9/1995 | F16B 7/0473 |
| FR | 2931524 | A1 * | 11/2009 | E04B 2/7433 |
| JP | 08312164 | A * | 11/1996 | E04G 7/22 |
| WO | WO-0042327 | A1 * | 7/2000 | F16B 7/0473 |
| WO | WO-0047904 | A1 * | 8/2000 | F16B 7/046 |
| WO | WO-2008050202 | A2 * | 5/2008 | F16B 7/0473 |
| WO | WO-2021142551 | A1 * | 7/2021 | F16B 7/0473 |

* cited by examiner

CLAMP FOR INTERCONNECTING COMPONENTS OF A SHORING APPARATUS

CROSS-REFERENCE TO RELATED APPLICATION(S)

This application claims the benefit under 35 U.S.C. § 119(e) to U.S. Provisional Application 62/948,587, filed Dec. 16, 2019, and entitled "Improved Clamp for Interconnecting Components of a Shoring Apparatus," which is hereby incorporated herein by reference in its entirety for all purposes.

FIELD

Disclosed herein are shoring devices used in forming concrete structures and, more specifically, a clamp useful in interconnecting components of such a shoring device which includes a moveable jaw that is moved to and held in a clamping position by a fluted pin.

BACKGROUND

Concrete forming devices are in wide use in the construction of buildings, bridges, and other concrete structures. The formwork against which the concrete is formed is often held in place by shores, walers, and the like. In creating a shoring apparatus having the desired strength, it is common to interconnect vertical and horizontal components of the shoring apparatus with support structures. Because of the variety in the size and shape of concrete structures formed using the shoring apparatus, it is advantageous to have the ability to interconnect the various components of the shoring apparatus in a wide variety of configurations without unduly multiplying the number of distinct components that are required to assemble the shoring apparatus of the desired diversity.

Accordingly, a number of attempts have been made to design clamps or couplings for interconnecting components of a shoring apparatus that are adjustable to fit a wide variety of configurations. One such coupling is described in U.S. Pat. No. 5,713,687. The patent describes a coupling for interconnecting a horizontal panel at any desired position along a pair of vertical shoring posts. The coupling has a mouth formed of a stationary and moveable jaw. The moveable jaw is closed towards the stationary jaw by driving behind the moveable jaw a wedge-shaped tensioning member. The coupling mouth when tensioned by the wedge, engages the vertical shoring post at the desired position. In an alternative embodiment, the wedge includes ribs that run at an angle with respect to the longitudinal axis of the wedge and which engage teeth on the moveable jaw to move it between an opened position and a clamped or tensioned position. Another such coupling is described in U.S. Pat. No. 6,322,277, which includes a clamp for interconnecting two components of a support apparatus. A clamp member having angled flutes is received for pivotal movement in the housing of the clamp such that axial movement of the clamp member causes a swing arm of the housing to pivot.

There is a need in the art for improved methods and devices for interconnecting components of a shoring apparatus that can resist the significant force required to engage such components.

BRIEF SUMMARY

Discussed herein are various shoring clamp embodiments having a clamp pin having a proximal head such that the pin can be positioned in the clamp body with substantial force without damaging the clamp or the pin or driving the clamp pin out of its desired position. In certain embodiments, the pin is also structured to reduce the amount of focused force applied to the clamp housing. The clamp includes a housing that is secured to a first component of the shoring apparatus. The housing has a fixed jaw which projects laterally of the first component and a moveable jaw that is mounted in the housing for pivotable movement in a direction which will move the moveable jaw toward and away from the fixed jaw. A clamp member comprises a pin that has a proximal cap and a plurality of flutes arranged about its outer periphery and disposed at an angle relative to the longitudinal, pivoting axis of the pin and clamp member. Recesses corresponding to the flutes are formed in the housing and the clamp member is received for guided vertical sliding movement inside the housing wherein the flutes of the pin are received inside the corresponding recesses formed in the housing. Movement of the clamped member along its longitudinal axis results in pivotable movement of the clamped member as a result of the engagement of the flutes with the recesses. A pivot or swing arm of the clamp member projects radially of the pin and has an outer end portion that is received within a corresponding socket in the moveable jaw. Accordingly. longitudinal movement of the clamp member will pivot the pivot arm and thereby move or swing the moveable jaw toward and away front the fixed jaw. The pitch of the flutes relative to the longitudinal axis of the clamp member in combination with the permitted longitudinal axis of the clamp member result in the moveable jaw being pivotable between an open position and a clamping position wherein the pair of jaws engage a mating surface on a second component of the shoring apparatus.

In Example 1, a clamp for releasably interconnecting a first component and a second component of a support apparatus, the clamp comprising a housing secured to the first component, the housing comprising a clamp pin opening in the housing, having at least one recess formed in the periphery of the opening, a fixed jaw extending from the housing and adapted to engage a first portion of the second component, and a moveable jaw pivotably mounted to the housing opposite from the fixed jaw and adapted to engage a second portion of the second component, a clamp pin comprising a pin body having a pivot axis and received within the clamp pin opening of the housing, a swing arm extended generally radially from the pin body and adapted to engage the moveable jaw, a proximal cap disposed at a proximal end of the pin body, and at least one flute extended generally radially from the pin and disposed at an angle relative to the pivot axis of the pin and received within the recess, whereby movement of the clamp pin along the pivot axis of the pin will pivot the swing arm and thereby the moveable jaw toward the fixed jaw to securely engage the second component between the jaws.

Example 2 relates to the clamp of Example 1, wherein the housing comprises a pair of opposite side portions, a pair of aligned openings forming the clamp pin opening, each of which is formed in a corresponding one of the side portions, and the at least one recess formed in the periphery of each of the pair of aligned openings.

Example 3 relates to the clamp of Example 2, wherein the pin comprises a distal end portion received within the aligned opening of a first of the side portions of the housing, and a proximal end portion received within the aligned opening of a second of the side portions of the housing, and at least two of the flutes, one of which extends from the first end portion of the pin and is received within the recess of the aligned opening in the first side portion of the housing and the second of which extends from the second end portion of the pin and is received within the recess of the aligned opening in the second side portion of the housing.

Example 4 relates to the clamp of Example 2, wherein the housing is generally U-shaped in transverse cross-section comprising a pair of parallel legs sections interconnected by a web, wherein the leg sections comprise the side portions and the fixed jaw extends from the web.

Example 5 relates to the clamp of Example 3, wherein the pin further comprises a central portion between the end portions which central portion is free of flutes whereby axial movement of the pin inside one of the pair of aligned openings in the area of the central portion will permit free pivotal movement of the pin unconstrained by the flutes and recesses.

Example 6 relates to the clamp of Example 5, wherein the swing arm is extended generally radially from the central portion of the pin.

Example 7 relates to the clamp of Example 1, wherein the first and second portions of the second component comprise parallel, opposing channels extended alone the second component and wherein the jaws are adapted to releasably engage the opposing channels at any position along the second component.

Example 8 relates to the clamp of Example 2, wherein the clamp member comprises a distal end portion of the pin, a proximal end portion of the pin, and a central portion between the distal and proximal end portions, a distal band comprising a plurality of the flutes arranged in parallel rows about the circumferential periphery of the pin and a proximal band comprising plurality of the flutes arranged in parallel rows about the circumferential periphery of the pin, the at least one recess comprising a plurality of recesses corresponding to the number and angular position of the flutes in the distal and proximal bands of the pin, wherein the plurality of recesses are formed in each of the pair of aligned openings in the side portions of the housing such that axial movement of the pin inside the openings results in pivotal movement of the moveable jaw through the range of motion wherein the flutes are engaged by the recesses, and wherein the swing arm extends from the central portion.

Example 9 relates to the clamp of Example 8, wherein the central portion on either side of the swing arm is devoid of flutes to allow pivotal movement of the clamp member within the housing unconstrained by the flute members and recesses when the pin has been axially moved to position a side portion of the housing in the area of the central portion that is devoid of flutes.

Example 10 relates to the clamp of Example 1, wherein the proximal cap is a reinforced proximal head configured to receive external force to cause axial movement of the clamp pin.

Example 11 relates to the clamp of Example 1, wherein the housing comprises an upper plate comprising a first opening defined within the upper plate, a lower plate comprising a second opening defined within the lower plate, wherein the second opening is aligned with the first opening, and at least one recess formed in the periphery of each of the openings, wherein the first and second openings are sized to receive the clamp pin.

Example 12 relates to the clamp of Example 11, wherein a distal surface of the proximal cap is positioned a predetermined distance from a distal surface of the swing arm such that when the distal surface of the swing arm is in contact with a top surface of the lower plate, the distal surface of the proximal cap is in contact with a top surface of the upper plate.

In Example 13, a clamping member for securing a first component to a second component of a shoring apparatus, the clamping member comprising a housing, comprising a first jaw portion and a second jaw portion, the first and second jaw portion shaped to engage the first component, and a pin opening, and a pin shaped to be disposed within the pin opening, such that the pin, the first jaw portion, and second jaw portion form a hinge, the pin comprising a pin body, a pin head disposed at one end of the pin body, and at least one flute extending from the pin body, the flute disposed at an angle relative to a longitudinal axis of the pin, wherein striking of the pin head causes longitudinal movement of the pin when the pin is inserted into the pin opening, and wherein longitudinal movement of the pin causes rotational movement of the first jaw portion relative to the second jaw portion.

Example 14 relates to the clamping member of Example 13, wherein the housing comprises a top plate, a bottom plate, a web configured to connect the top plate and the bottom plate, and a throughbore through the top plate and the bottom plate, wherein insertion of an elongate member through the throughbore secures the housing to the second component.

Example 15 relates to the clamping member of Example 13, wherein the first jaw portion is configured to engage a first channel of the first component, and wherein the second jaw portion is configured to engage a second channel of the first component.

Example 16 relates to the clamping member of Example 13, the pin further comprising a swing arm extending radially from the pin body.

Example 17 relates to the clamping member of Example 13, the pin further comprising a proximal band of flutes and a distal band of flutes wherein the flutes of the proximal band are paired with the flutes of the distal band, and wherein each flute has a paired flute on a substantially opposite lateral side of the pin.

Example 18 relates to the clamping member of Example 17, wherein each of the proximal band and the distal band comprise four flutes.

Example 19 relates to the clamping member of Example 13, wherein a diameter of the pin head is greater than a diameter of the pin opening.

In Example 20, a clamp comprising a housing comprising a clamp pin opening in the housing, having at least one recess formed in the periphery of the opening, a fixed jaw extending from the housing, and a moveable jaw pivotably mounted to the housing opposite the fixed jaw, and a clamp pin comprising a pin body having a longitudinal axis and shaped to be received within the clamp pin opening, a swing arm extended generally radially from the pin body and adapted to engage the moveable jaw, a pin head disposed at a proximal end of the pin body, and at least one flute extended generally radially from the pin and disposed at an angle relative to the longitudinal axis of the pin and received within the recess, whereby movement of the clamp pin along the longitudinal axis causes pivot the swing arm and thereby the rotational movement of the moveable jaw toward the fixed jaw.

While multiple embodiments are disclosed, still other embodiments will become apparent to those skilled in the art from the following detailed description, which shows and describes illustrative embodiments. As will be realized, the various implementations are capable of modifications in various obvious aspects, all without departing from the spirit and scope thereof. Accordingly, the drawings and detailed description are to be regarded as illustrative in nature and not restrictive.

DETAILED DESCRIPTION

The various embodiments disclosed or contemplated herein relate to a clamp for releasably securing components of a shoring apparatus. The various clamp embodiments are durable, quickly and easily moveable between a released and a clamped position, and have the requisite strength for their intended use while being economical to manufacture. Further, the clamp implementations have a clamp member that can be urged into its desired position with substantial force (including, for example, with a hammer or similar tool) without damaging the clamp or driving the clamp member out of its desired position.

Figure 1:
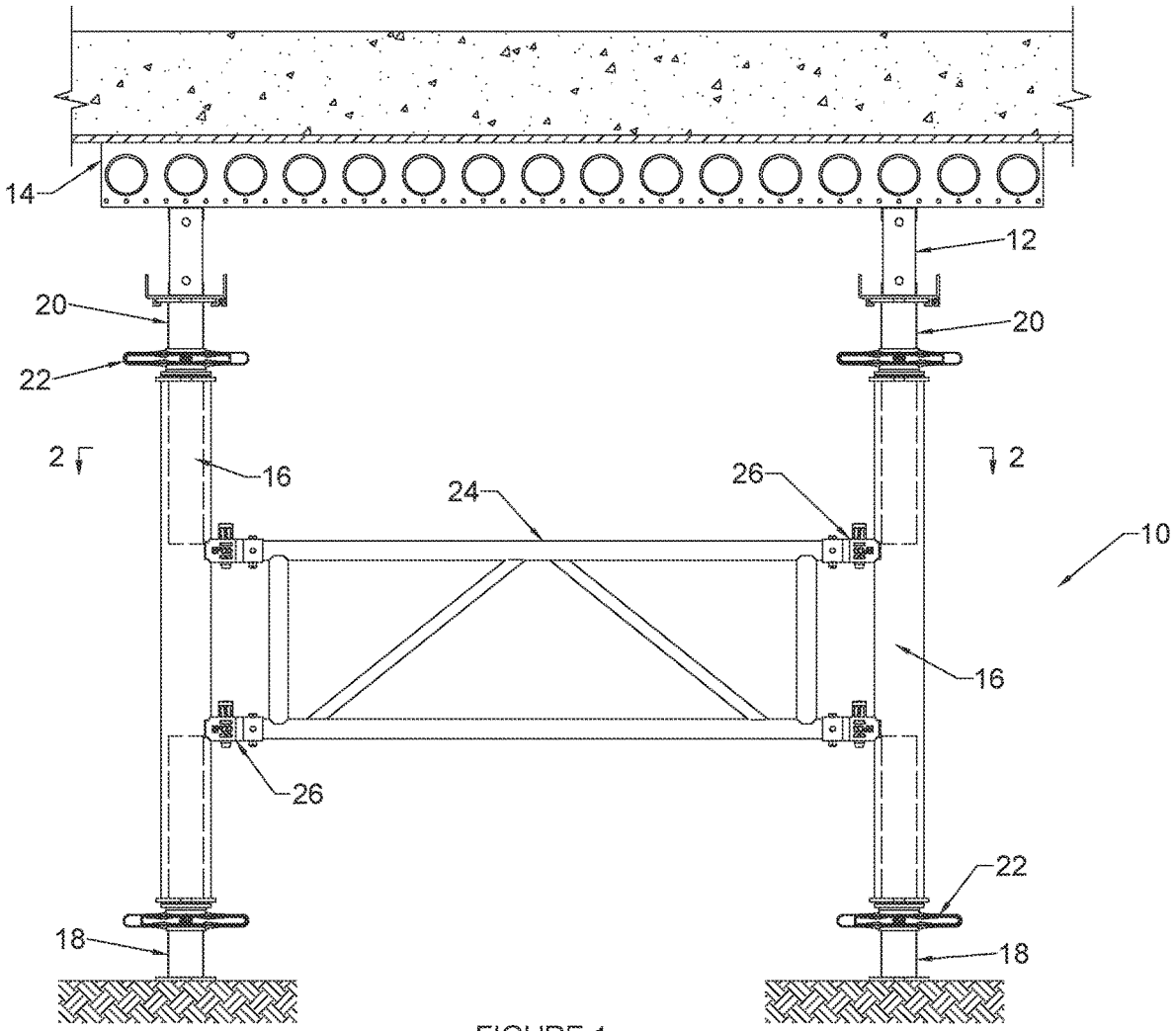
FIG. 1 is an elevational view of a typical shoring apparatus when clamps according to one embodiment are used to interconnect components of the shoring apparatus.

Referring to the drawings, FIG. 1 depicts a shoring apparatus 10 for supporting concrete forms such as the beams 12 and 14, according to one embodiment. The shoring apparatus 10 includes a plurality of shoring posts 16, each of which is supported on a bottom jack 18 and has extended from its upper end section a top jack 20. The shoring posts 16 are of a fixed length but the total height of the shoring apparatus 10 is adjustable by rotation of a plurality of wing nuts 22 that are threaded about the bottom jacks 18 and top jacks 20 and which abut against the ends of the shoring posts 16.

Figure 2:
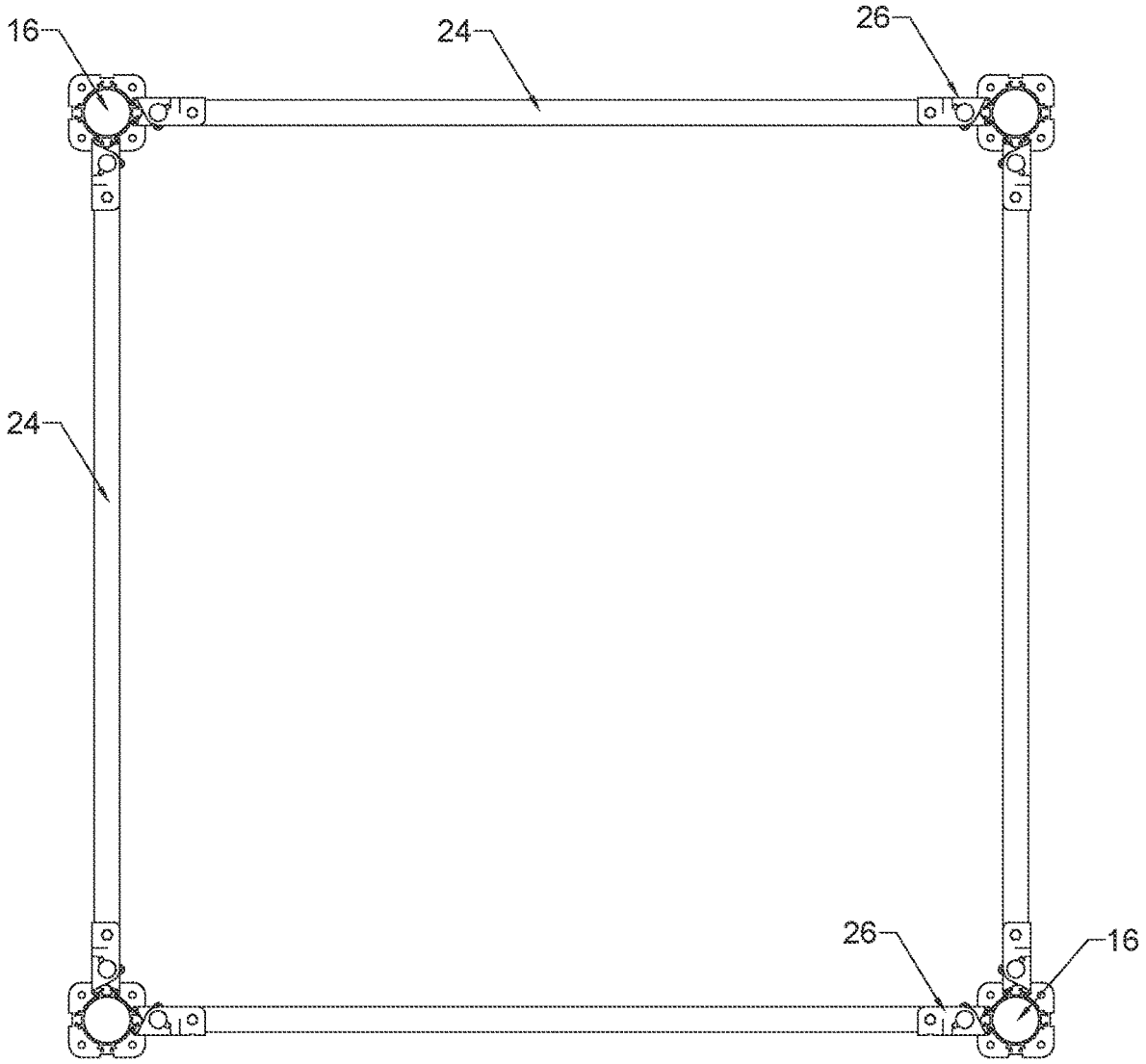
FIG. 2 is a sectional view taken along line 2-2 of FIG. 1, according to one embodiment.

One or more horizontally disposed panels 24 may be interconnected between adjacent shoring posts 16 to provide added strength to the shoring apparatus 10 and also to provide means for supporting a platform or the like upon which workers can stand who assemble the shoring apparatus 10 and the associated concrete forming apparatus, pour the concrete contained by the forms, and strip the forms after the concrete has set. As illustrated in FIG. 2, a common configuration uses four shoring posts 16 that are interconnected by four panels 24. Because of the need to adapt the various components of the shoring apparatus 10 to assemble shoring systems to support concrete forms in the wide variety of configurations demanded by architects and building contractors, it is desirable to be able to interconnect the shoring apparatus components at adjusted positions and to be able to do so quickly and reliably without a sacrifice in strength.

The panels 24 are interconnected with the vertical shoring posts 16 at any desired position along the length of the shoring posts 16 by a plurality of clamping members 26. The clamping members 26 are secured to the ends of the cross-bars of the panels 24 and are adapted to be releasably clamped at adjusted positions on the shoring posts 16.

Figure 3A:
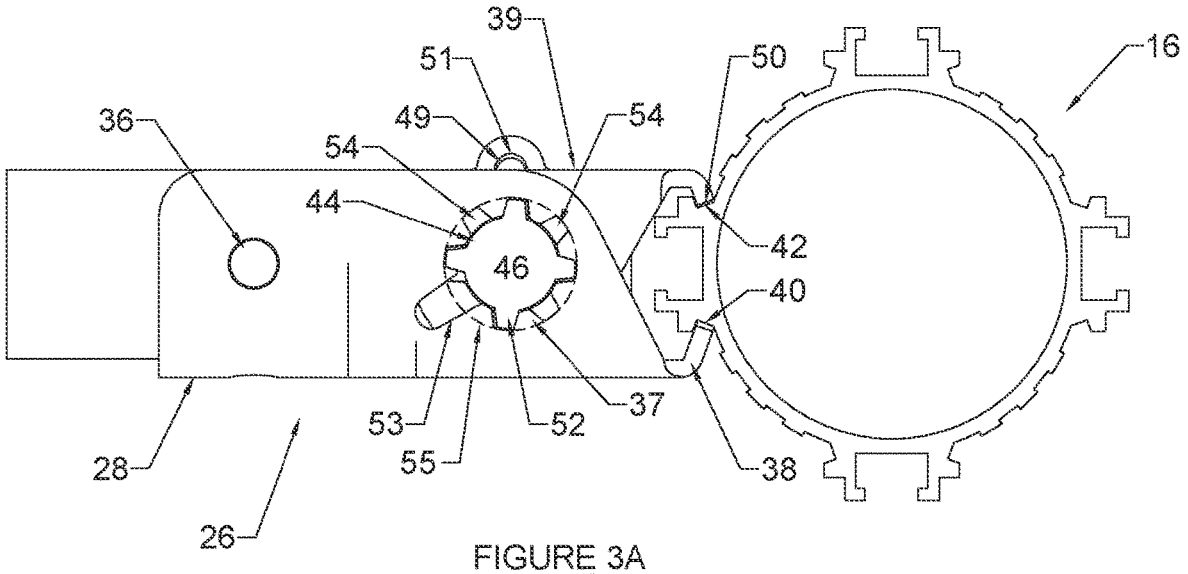
FIG. 3A is an enlarged detailed top view showing a clamp according to one embodiment engaged with a shoring post.
Figure 3B:
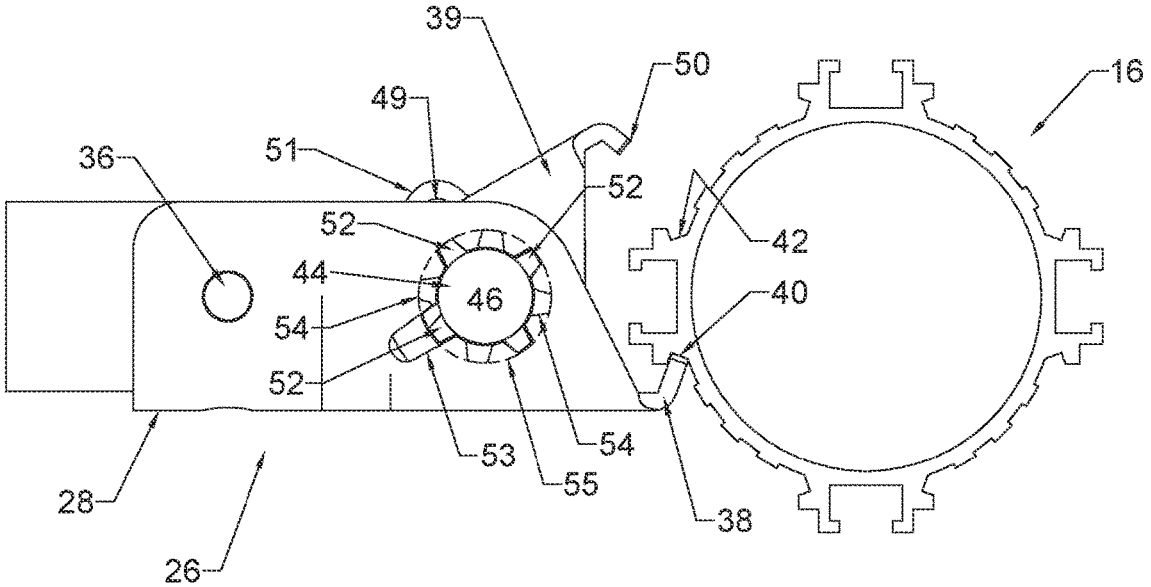
FIG. 3B is an enlarged detailed top view showing the clamp of FIG. 3A according to one embodiment in which the clamp is partially opened for detachment from the shoring post.
Figure 3C:
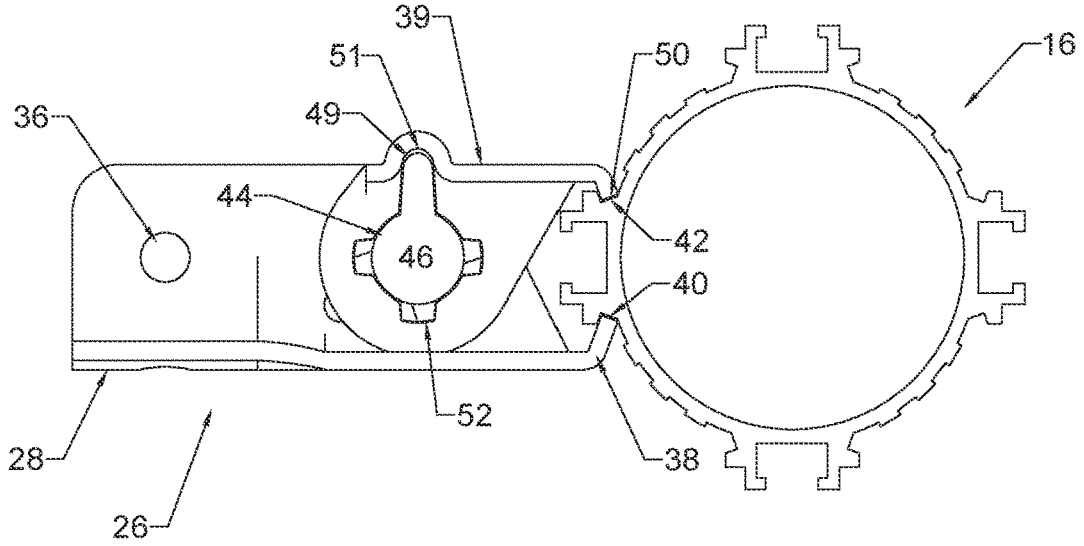
FIG. 3C is a cross-sectional view of the clamp of FIGS. 3A and 3B according to one embodiment.
Figure 4:
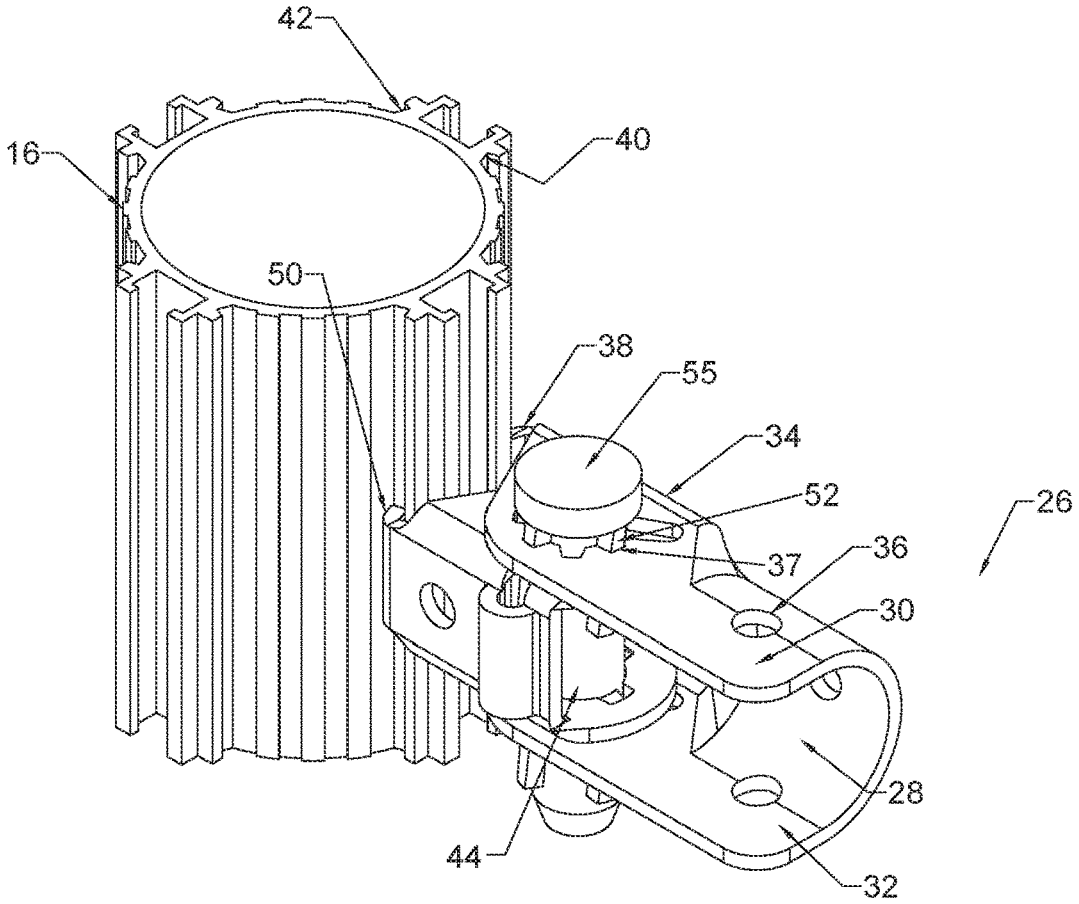
FIG. 4 is a perspective view of the clamp of FIG. 3A attached to a shoring post, according to one embodiment.

A detailed view of a clamp 26 in accordance with one implementation is illustrated in FIGS. 3 and 4. As best shown in FIG. 4, the clamp 26 includes a housing 28 that is of a generally U-shape in transverse cross section, having a top section (also referred to as a "top plate") 30, a bottom section (also referred to as a "bottom plate") 32, and an interconnecting web 34. A throughbore 36 is provided in the top section 30 and bottom section 32 and receives a nut and bolt combination (not shown) or the like to secure the housing 28 to a cross member of a panel 24. Further, a pin opening 37 is defined in the top section 30 and the bottom section 32 of the housing 28 and further defined in the moveable jaw 39, which is discussed in detail below. The pin opening 37 is configured to receive the clamp pin 44 that operably and rotatably couples the moveable jaw 39 and the housing 28 as discussed below. The distal end portion of the web 34 is in-turned or angled to form a fixed jaw 38 of the clamp 26. The configuration of the fixed jaw 38 is adapted to securely engage one side of a pair of opposing channels 40 and 42 that are formed in the extrusion that comprises the shoring post 16.

The housing 28 also includes a moveable jaw 39 that is mounted in the housing 28 for pivotal movement toward and away from the fixed jaw 38 via the pin 44 as discussed in detail below. An in-turned or angled end portion 50 of the moveable jaw 39 is adapted to securely engage the opposite one of the opposing channels 40 and 42 from the fixed jaw 38.

FIGS. 5-7C depict one embodiment of a clamp pin (also referred to herein as a "clamp member" or "bobber") 44 that can be positioned within the clamp 26 to operably couple the moveable jaw 39 to the housing 28 as described herein. The pin 44 includes a pin body 46 and a swing arm 48 which extends generally radially from the pin body 46. As best shown in FIGS. 3A and 3B, the outer end portion 49 of the swing arm 48 is received in a socket 51 formed in the moveable jaw 39.

Figure 7A:
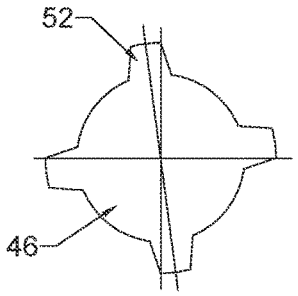
FIGS. 7A-7C are section views taken along the lines A-C of FIG. 6, according to one embodiment.
Figure 7B:
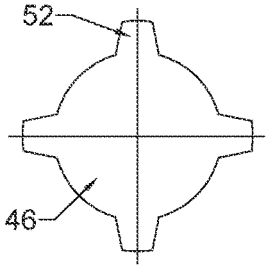
Figure 7C:
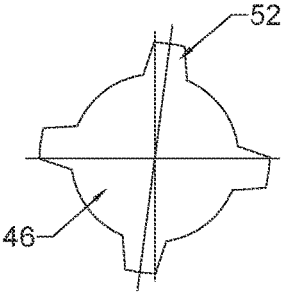

The pin body 46 is constructed with radially extending flutes 52 that are arranged in a pair of bands 52A, 52B encircling either end portion of the pin body 46. The distal band 52A is disposed at or near the distal end, while the proximal band 52B is disposed at or near the proximal end as shown. The flutes 52 in each pair 52A, 52B are arranged in pairs on opposite lateral sides of the pin body 46 so that each of the bands of flutes 52A, 52B includes a total of four flutes 52 (as best shown in FIGS. 7A-7C). In the preferred embodiment, the flutes 52 are oriented 90 degrees away from the adjacent flutes 52. The flutes 52 are disposed at an angle relative to the longitudinal axis of the pin body 46. The flutes 52, accordingly, act as threads on the pin body 46 when disposed within the pin opening 37.

Figure 5:
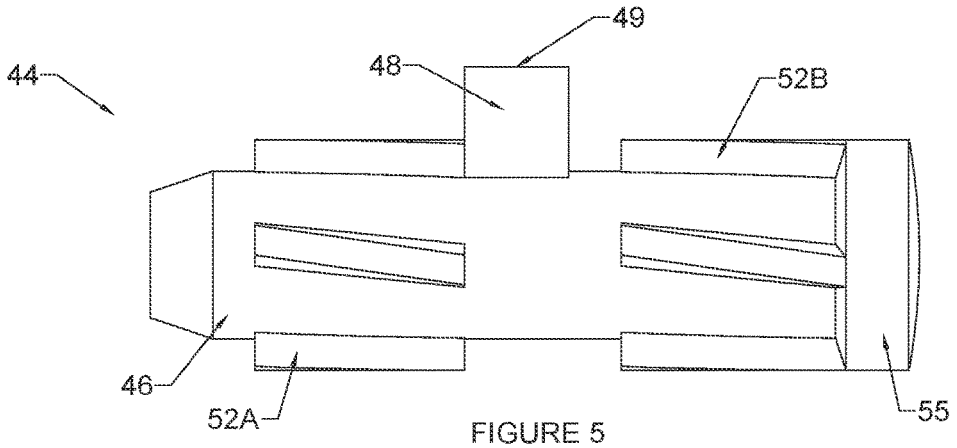
FIG. 5 is an enlarged detail side view of a clamping member, according to one embodiment.

In this implementation, the pin 44 also has a cap (also referred to herein as a "head") 55 disposed at the proximal end of the pin body 46 as depicted in FIG. 5. As such, the head 55 is coupled to the proximal band of flutes 52B such that each flute 52 in the band 52B is, at one end of the flute 52, attached to or integral with the head 55 as shown. The head 55 has an outer diameter that is substantially equal to the outer diameter of the flutes 52. As such, the head 55 has a diameter that is greater than the diameter of the pin opening 37 such that the head 55 cannot pass through the pin opening 37. As such, as discussed in further detail below, the pin 44 can only be inserted into the pin opening 37 through the top plate 30 as best shown in FIG. 4 to the point at which the head 55 contacts the top plate 30. Of course, it is understood that while the plate 30 is referred to herein as the "top" plate 30 for purposes of identification, the clamp 26 can be disposed such that the top plate 30 is either on the top or the bottom of the device during use.

As best shown in FIGS. 3A and 3B, the pin opening 37 defined within the top plate 30 and the bottom plate 32 of the housing 28 has notches (or "recesses") 54 defined or formed in the edge of the opening 37 that correspond to the flutes 52, with the recesses 54 of the top plate 30 receiving the flutes 52 in the proximal band 52B of the clamp member 44 and the recesses 54 in the bottom plate 32 receiving the flutes 52 of the distal band 52A of the clamp member 44. The recesses 54 in the top plate 30 are oriented at an angle with respect to the recesses 54 in the bottom plate 32 that corresponds to the relative angular orientation of the flutes 52 of the proximal band 52B relative to the flutes 52 of the distal band 52A at the distance separating the top plate 30 and the bottom plate 32. Accordingly, the recesses 54 act like mating female threads to the male threads that are the flutes 52. Vertical (or longitudinal) adjustment of the clamp member 44 relative to the housing 28 (that is, distal or proximal movement of the pin 44) will thus result in pivotal or rotational movement of the clamp member 44 about the longitudinal axis of the pin body 46, which causes the swing arm 48 and thereby the movable jaw 39 to swing or pivot toward and away from the fixed jaw 38 (as shown in FIGS. 3A and 3B).

In operation, the panel 24 (as best shown in FIG. 1) is positioned so that the fixed jaw 38 is placed inside the channel 40 of the shoring post 16 at the desired position (as best shown in FIG. 3B). The clamp member 44 disposed within the pin opening 37 is then urged distally (or "downwardly"), thereby causing the movable jaw 48 to rotate or pivot toward the shoring post 16 and then into engagement with the opposing channel 42 (as best shown in FIG. 3A). The pin 44 is urged distally until the cap makes contact with the top plate 30 such that the pin 44 can advance no further. In some embodiments, a hammer or other tool is used to tap the proximal end of the pin body 46 of the clamp member 44 distally to secure the clamp 26 in its locked position engaging the opposing channels 40 and 42 of the shoring post 16. The head 55 provides two benefits for the pin body 46: it provides a larger target striking surface (in comparison to a pin body 46 without a head) for the hammer or other tool, and it ensures appropriate positioning of the pin body 46 within the housing 28. That is, the hammer or other tool can be used to strike the head 55 until the pin body 46 is advanced distally such that the head 55 is urged into contact with the top plate 30. According to certain implementations in which the housing 28 and/or the pin 44 have worn as a result of use, the use of a hammer or other tool to forcibly strike the pin 44 can be necessary to ensure sufficient engagement of the clamp 26 with the channels 40, 42 of the post 16. Regardless of whether striking the pin body 46 is necessary or simply beneficial, the diameter of the head 55 prevents the pin body 46 from being urged too far distally into the pin opening 37 as a result of the striking of the body 46 with the tool.

Further, in certain embodiments, the pin body 46 is dimensioned such that the swing arm 48 and the head 55 are positioned at a predetermined distance from each other such that when the pin 44 is urged distally into the housing 28 such that the distal surface of the swing arm 48 contacts the surface of the lower plate 32, the distal surface of the head 55 also contacts the surface of the top plate 30. This simultaneous contact of two components of the pin 44 with two components of the housing 28 can reduce the amount of focused force applied to the housing 28 (by distributing to two contact surfaces instead of one), thereby reducing the structural damage to the housing 28 during use and thus increasing the longevity of the housing 28. According to one implementation, the housing 28 is constructed such that the fixed jaw 38 is structurally stronger than the moveable jaw 39. The stronger fixed jaw 38 ensures that, if damage to the housing 28 does occur as a result of the pin 44 being pounded into the housing 28, it will typically occur first in the moveable jaw 39. Given that both the moveable jaw 39 and the pin 44 are easily and quickly replaceable, this further enhances the longevity of the housing 28.

It is understood that the clamping action can easily be reversed as well. That is, the clamp 26 may be quickly and easily released by tapping the distal end of the body 46 proximally with the hammer or other tool.

Figure 6:
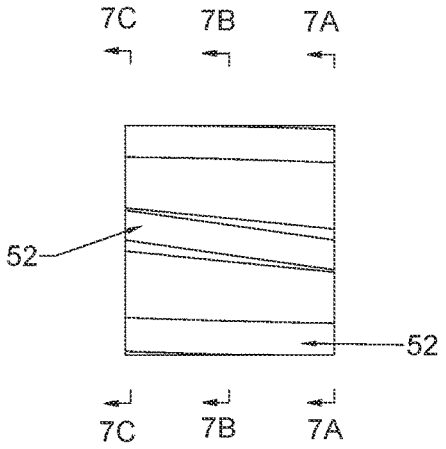
FIG. 6 is a partial view of the flutes corresponding to FIG. 5, according to one embodiment.

As mentioned above, in one embodiment, the flutes 52 are disposed at an angle relative to the longitudinal axis of the pin body 46 such that longitudinal or "vertical" movement of the clamp member 44 (that is, distal or proximal movement) will result in the movable jaw pivoting through a predetermined angle as shown in FIGS. 3A and 3B. In FIGS. 7A-7C, there is illustrated sections of FIG. 6 taken at fixed intervals along the length of the body 46 as shown in FIG. 6.

To assure that the movable jaw of the clamp member 44 does not interfere with repositioning or removal of the panel 24 (as shown in FIG. 1), the clamp member 44 may be moved proximally (or "upwardly") until the flutes 52 of the proximal band 52B are disposed outside of the pin opening 37 such that the flutes 52 of the proximal band 52B clear the top plate 30. In this position, clamp member 44 is free to pivot through the full range of motion unrestricted by engagement of the flutes 52 and the recesses 54. Moreover, the clamp member 44 may be pivoted to move the swing arm 48 into alignment with an elongated opening 53 in the top of the housing 28 to allow insertion of the clamp member 44 into the housing. In the preferred embodiment, after the insertion of the clamp member 44, the housing 28 is attached to a rail of the panel 24. The housing 28 is sized so that the rail will extend into the housing 28 a sufficient distance to allow limited pivotal movement of the clamp member 44 through its required operation range yet prevent it from being pivoted so far as to align the swing arm 48 with the opening 53, thereby preventing loss of the clamp member 44 in the field.

Although the various embodiments have been described with reference to preferred implementations, persons skilled in the art will recognize that changes may be made in form and detail without departing from the spirit and scope thereof.

What is claimed is:

1. A clamp for releasably interconnecting a first component and a second component of a support apparatus, the clamp comprising:

(a) a housing secured to the first component, the housing comprising:

(i) a clamp pin opening in the housing, having at least one recess formed in the periphery of the opening;

(ii) a fixed jaw extending from the housing and adapted to engage a first portion of the second component;

(iii) a moveable jaw pivotably mounted to the housing opposite from the fixed jaw and adapted to engage a second portion of the second component;

(iv) an upper plate comprising a first opening defined within the upper plate;

(v) a lower plate comprising a second opening defined within the lower plate, wherein the second opening is aligned with the first opening; and (vi) at least one recess formed in the periphery of each of the openings, wherein the first and second openings are sized to receive the clamp pin;

(b) a clamp pin comprising:

(i) a pin body having a pivot axis and received within the clamp pin opening of the housing;

(ii) a swing arm extended generally radially from the pin body and adapted to engage the moveable jaw;

(iii) a proximal cap disposed at a proximal end of the pin body; and (iv) at least one flute extended generally radially from the pin and disposed at an angle relative to the pivot axis of the pin and received within the recess, whereby movement of the clamp pin along the pivot axis of the pin will pivot the swing arm and thereby the moveable jaw toward the fixed jaw to securely engage the second component between the jaws, wherein a distal surface of the proximal cap is positioned a predetermined distance from a distal surface of the swing arm such that when the distal surface of the swing arm is in contact with a top surface of the lower plate, the distal surface of the proximal cap is in contact with a top surface of the upper plate.

2. The clamp of claim 1, wherein the housing further comprises:

(a)

a pair of aligned openings forming the clamp pin opening, each of which is formed in a corresponding one of the upper plate and the lower plate; and (b) the at least one recess formed in the periphery of each of the pair of aligned openings.

3. The clamp of claim 2, wherein the pin comprises:

(a) a distal end portion received within the aligned opening of the lower plate of the housing, and a proximal end portion received within the aligned opening of the upper plate of the housing; and (b) at least two of the flutes, one of which extends from the distal end portion of the pin and is received within the recess of the aligned opening in the lower plate of the housing and the second of which extends from the proximal end portion of the pin and is received within the recess of the aligned opening in the upper plate of the housing.

4. The clamp of claim 2, wherein the housing is generally U-shaped in transverse cross-section comprising a pair of parallel legs sections interconnected by a web, wherein the leg sections comprise the upper late and the lower plate and the fixed jaw extends from the web.

5. The clamp of claim 3, wherein the pin further comprises a central portion between the end portions which central portion is free of flutes whereby axial movement of the pin inside one of the pair of aligned openings in the area of the central portion will permit free pivotal movement of the pin unconstrained by the flutes and recesses.

6. The clamp of claim 5, wherein the swing arm is extended generally radially from the central portion of the pin.

7. The clamp of claim 1, wherein the first and second portions of the second component comprise parallel, opposing channels extended alone the second component and wherein the jaws are adapted to releasably engage the opposing channels at any position along the second component.

8. The clamp of claim 2, wherein the clamp member comprises:

(a) a distal end portion of the pin, a proximal end portion of the pin, and a central portion between the distal and proximal end portions;

(b) a distal band comprising a plurality of the flutes arranged in parallel rows about the circumferential periphery of the pin and a proximal band comprising plurality of the flutes arranged in parallel rows about the circumferential periphery of the pin;

(c) the at least one recess comprising a plurality of recesses corresponding to the number and angular position of the flutes in the distal and proximal bands of the pin, wherein the plurality of recesses are formed in each of the pair of aligned openings in the upper plate and the lower plate of the housing such that axial movement of the pin inside the openings results in pivotal movement of the moveable jaw through the range of motion wherein the flutes are engaged by the recesses; and (d) wherein the swing arm extends from the central portion.

9. The clamp of claim 8, wherein the central portion on either side of the swing arm is devoid of flutes to allow pivotal movement of the clamp member within the housing unconstrained by the flute members and recesses when the pin has been axially moved to position the upper plate of the housing in the area of the central portion that is devoid of flutes.

10. The clamp of claim 1, wherein the proximal cap is a reinforced proximal head configured to receive external force to cause axial movement of the clamp pin.

11. A clamping member for securing a first component to a second component of a shoring apparatus, the clamping member comprising:

(a) a housing, comprising:

(i) a first jaw portion and a second jaw portion, the first and second jaw portion shaped to engage the first component;

(ii) a pin opening;

(iii) a first plate; and (iv) a second plate; and (b) a pin shaped to be disposed within the pin opening the pin comprising:

(i) a pin body;

(ii) a swing arm extended from the pin body;

(iii) a pin head disposed at one end of the pin body; and (iv) at least one flute extending from the pin body, the flute disposed at an angle relative to a longitudinal axis of the pin, wherein striking of the pin head causes longitudinal movement of the pin when the pin is inserted into the pin opening, wherein longitudinal movement of the pin causes rotational movement of the first jaw portion relative to the second jaw portion, and wherein the pin head is positioned a predetermined distance from a distal surface of the swing arm such that when the distal surface of the swing arm is in contact with the second plate, the pin head is in contact with the first plate.

12. The clamping member of claim 11, wherein the housing further comprises:

(a)

a web configured to connect the first plate and the second plate; and (b) a throughbore through the first plate and the second plate, wherein insertion of an elongate member through the throughbore secures the housing to the second component.

13. The clamping member of claim 11, wherein the first jaw portion is configured to engage a first channel of the first component, and wherein the second jaw portion is configured to engage a second channel of the first component.

14. The clamping member of claim 11, the pin further comprising:

(a) a proximal band of flutes; and (b) a distal band of flutes;

wherein the flutes of the proximal band are paired with the flutes of the distal band, and wherein each flute has a paired flute on a substantially opposite lateral side of the pin.

15. The clamping member of claim 14, wherein each of the proximal band and the distal band comprise four flutes.

16. The clamping member of claim 11, wherein a diameter of the pin head is greater than a diameter of the pin opening.

17. A clamp comprising:

(a) a housing comprising:

(i) a clamp pin opening in the housing, having at least one recess formed in the periphery of the opening;

(ii) a fixed jaw extending from the housing;

(iii) a moveable jaw pivotably mounted to the housing opposite the fixed jaw;

(iv) an upper plate; and (v) a lower plate (b) a clamp pin comprising:

(i) a pin body having a longitudinal axis and shaped to be received within the clamp pin opening;

(ii) a swing arm extended generally radially from the pin body and adapted to engage the moveable jaw;

(iii) a pin head disposed at a proximal end of the pin body; and (iv) at least one flute extended generally radially from the pin and disposed at an angle relative to the longitudinal axis of the pin and received within the recess, whereby movement of the clamp pin along the longitudinal axis causes pivoting of the swing arm and thereby the rotational movement of the moveable jaw toward the fixed jaw wherein the pin head is positioned a predetermined distance from a distal surface of the swing arm such that when the distal surface of the swing arm is in contact with the lower plate, the proximal cap is in contact with the upper plate.

* * * * *